US009339864B2

(12) United States Patent
Hosoi

(10) Patent No.: US 9,339,864 B2
(45) Date of Patent: May 17, 2016

(54) MANUFACTURING METHOD AND MANUFACTURING APPARATUS OF SCREW-THREADED BOTTLE-CAN

(71) Applicant: UNIVERSAL CAN CORPORATION, Tokyo (JP)

(72) Inventor: Masahiro Hosoi, Sunto-gun (JP)

(73) Assignee: UNIVERSAL CAN CORPORATION, Tokyo (JP)

( * ) Notice: Subject to any disclaimer, the term of this patent is extended or adjusted under 35 U.S.C. 154(b) by 70 days.

(21) Appl. No.: 14/384,588

(22) PCT Filed: Mar. 19, 2013

(86) PCT No.: PCT/JP2013/057827

§ 371 (c)(1),
(2) Date: Sep. 11, 2014

(87) PCT Pub. No.: WO2013/146470

PCT Pub. Date: Oct. 3, 2013

(65) Prior Publication Data

US 2015/0013416 A1 Jan. 15, 2015

(30) Foreign Application Priority Data

Mar. 27, 2012 (JP) ..... 2012-071109

(51) Int. Cl.
*B21H 3/02* (2006.01)
*B21D 51/26* (2006.01)
(Continued)

(52) U.S. Cl.
CPC *B21H 3/02* (2013.01); *B21D 51/26* (2013.01); *B21D 51/2615* (2013.01);
(Continued)

(58) Field of Classification Search
CPC ..... B21H 3/02; B21H 3/022; B21H 3/04; B21H 3/08; B21D 19/04; B21D 19/046; B21D 19/06; B21D 19/12; B21D 19/16; B21D 51/24; B21D 51/26; B21D 51/2607; B21D 51/2615; B21D 51/2623; B21D 51/263; B21D 51/2638; B21D 51/38; B65D 1/0207; B65D 1/023; B65D 1/0246; Y10T 29/49917; Y10T 29/49918
USPC ..... 72/68, 103, 105, 106, 112–114, 118, 72/120–124, 126, 208, 365.2, 370.02, 72/370.16, 370.17, 370.18, 715; 413/23
See application file for complete search history.

(56) References Cited

U.S. PATENT DOCUMENTS

| | | | |
|---|---|---|---|
| 5,293,765 | A | 3/1994 | Nussbaum-Pogacnik |
| 5,704,240 | A | 1/1998 | Jordan |
| 2005/0067365 | A1 | 3/2005 | Hanafusa et al. |

FOREIGN PATENT DOCUMENTS

| | | | |
|---|---|---|---|
| JP | 05-229545 | A | 9/1993 |
| JP | 2002-66674 | A | 3/2002 |

(Continued)

OTHER PUBLICATIONS

International Search Report mailed Jun. 18, 2013 for the corresponding PCT Application No. PCT/JP2013/057827.

*Primary Examiner* — Peter DungBa Vo
*Assistant Examiner* — Joshua D Anderson
(74) *Attorney, Agent, or Firm* — Leason Ellis LLP.

(57) ABSTRACT

A manufacturing method for a screw-threaded bottle-can including the steps of: forming a shoulder part, a pipe part, a tapered part and an aperture-end part above a trunk part; and forming a screw-thread part by an inner mold and an outer mold in which the pipe part is sandwiched therebetween. An outer diameter of the pipe part is formed to an intermediate diameter between a ridge diameter and a bottom diameter of the screw-thread part. The screw-thread part is formed from the tapered part to the pipe part so as to form a screw-starting part at an intermediate position of the tapered part. A height of a first step of a right-hand screw-type protrusion of the inner mold is formed to be lower than a height of a second and subsequent steps in an angle range of 90° circumferentially continuing from the screw-starting part.

3 Claims, 14 Drawing Sheets

(51) Int. Cl.
*B65D 1/02* (2006.01)
*B21D 51/38* (2006.01)

(52) U.S. Cl.
CPC ..... *B21D 51/2623* (2013.01); *B21D 51/38* (2013.01); *B21H 3/022* (2013.01); *B65D 1/0207* (2013.01); *B65D 1/0246* (2013.01)

(56) References Cited

FOREIGN PATENT DOCUMENTS

| | | | |
|---|---|---|---|
| JP | 2004-74168 | A | 3/2004 |
| JP | 2004-83128 | A | 3/2004 |
| JP | 2004-148403 | A | 5/2004 |
| JP | 2006-176140 | A | 7/2006 |

MANUFACTURING METHOD AND MANUFACTURING APPARATUS OF SCREW-THREADED BOTTLE-CAN

CROSS-REFERENCE TO RELATED PATENT APPLICATIONS

This application is a U.S. National Phase Application under 35 U.S.C. §371 of International Patent Application No. PCT/JP20131057827, filed Mar. 19, 2013, and claims the benefit of Japanese Patent Application No. 2012-071109, filed on Mar. 27, 2012, all of which are incorporated by reference in their entirety herein. The International Application was published in Japanese on Oct. 3, 2013 as International Publication No. WO/2013/146470 under PCT Article 21(2).

BACKGROUND OF THE INVENTION

1. Field of the Invention

The present invention relates to a manufacturing method and manufacturing apparatus of a screw-threaded bottle-can having a screw-thread on which a cap is screwed.

2. Description of the Related Art

A can (a bottle-can) having a bottle-shape of aluminum alloy in which a cap is screwed on a mouth section having a screw-thread is known as a container filled with contents such as drinks.

The bottle-can is, as disclosed by U.S. Pat. No. 5,704,240, Japanese Unexamined Patent Application, First Publication No. H05-229545, and Japanese Unexamined Patent Application, First Publication No. 2002-66674, manufactured by: performing a drawing processing and an ironing processing (i.e., a DI forming) so as to form an aluminum alloy sheet into a cylindrical body having a bottom plate part and a cylindrical-lateral part being integral with each other; narrowing an aperture section so as to form a shoulder part; forming a neck part of a small diameter on an upper end of the shoulder part and forming an expanded pipe part on an upper part of the neck part for screw-forming; performing a screw-forming processing on the pipe part; and performing a curl-forming processing on an aperture-end part, and the like.

In the manufacturing process of the bottle-can, a screw-thread part is formed by inserting the pipe part between an inner mold inserted in the pipe part and an outer mold outside the pipe part, and revolving the inner mold and the outer mold around an axis of the can while rotating the inner mold and the outer mold on their own axes. The screw-thread part is usually a right-hand screw. In order to form the right-hand screw, a right-hand screw-type protrusion is formed on the inner mold, and a left-hand screw-type protrusion is formed on the outer mold.

Japanese Unexamined Patent Application, First Publication No. 2002-66674 describes a method of processing an aperture part without damaging to an inner coat of a can, by forming a mouth section to have at least two or more steps from a shoulder part in an intermediate-formed product before a screw-forming processing by a drawing processing; a pipe part is formed on a second step from the aperture end to have an outer diameter of an intermediate diameter between an outer diameter of a screw-ridge and an outer diameter of a screw-bottom; and a screw-forming process is performed by inserting the pipe part between an inner mold and an outer mold.

The present applicant has proposed in Japanese Unexamined Patent Application, First Publication No. 2004-74168 to reduce torque for closing a cap again after once opening, by setting a height of a first step of a screw-ridge from an aperture end to be lower than heights of second and subsequent steps of the screw-ridge among a plurality of steps of the screw-ridge.

Problems to be Solved by the Invention

Cans of this kind can be sealed by putting the cap again after once opening, and a resealing operation is improved by technology in Japanese Unexamined Patent Application, First Publication No. 2004-74168. However, unlike bottle containers, since the bottle-can is made of metal, there is a problem that dimensions of the screw-thread part are not stable. That is, when forming a screw-thread, it is necessary to process not to damage on the coating as described in Japanese Unexamined Patent Application, First Publication No. 2002-66674; on the other hand, if the deformation is gentle, there is a problem that the dimensions would not be stable by spring-back and the like; as a result, torque for the resealing operation is increased, so that further improvement is required.

The present invention is achieved in consideration of the above circumstances, and has an object to provide a manufacturing method and a manufacturing apparatus of a screw-threaded bottle-can which can perform a screw-thread forming without damaging to coatings and the like, with stable dimensions, and improve the resealing performance.

Means for Solving the Problem

By intensive research on the resealing operation after opening, the inventor came to a conclusion that: it is advantageous for reducing resistance of the cap putting on when resealing to set a height of a first step from an aperture end to be lower than heights of a second and subsequent steps in a screw-ridge as described in Japanese Unexamined Patent Application, First Publication No. 2004-74168; and in order to form the state stably, it is important to set rolling directions of an inner mold and an outer mold to specific directions for a screw-forming process. Moreover, the inventor came to a conclusion that: it is not enough to set the height of the first step of the screw-ridge to be low; and it is important not to generate resistance by the resealing operation while a lowest end of a screw-thread on an inner surface of the cap is guided to a screw-bottom between the first step and the second step of the screw-ridge, so that a solution to the present invention is as follows.

SUMMARY OF THE INVENTION

A manufacturing method of a screw-threaded bottle-can according to the present invention, including: an intermediate-formed product forming process forming an intermediate-formed product having a shoulder part which is gradually tapered upward from an upper end of a trunk part, a neck part which is extended upward from an upper end of the shoulder part having a cylindrical shape, a surplus-thickness part which is swelled out as a protrusion streak or swelled in as a recessed groove round an upper end part of the neck part, a pipe part which is extended upward from an upper end of the surplus-thickness part, and a tapered part which is tapered from an upper end of the pipe part toward an aperture-end part; and a screw-forming process using a screw-forming tool provided with: an inner mold having a right-hand screw-type protrusion and an inner-mold swell part swelling outward around a lower part of the right-hand screw-type protrusion; and an outer mold having a left-hand screw-type protrusion and an outer-mold swell part swelling outward around a lower part of the left-hand screw-type protrusion, arranging the inner mold inside the pipe part and the surplus-thickness part and arranging the outer mold outside the pipe part and the surplus-thickness part, interposing the surplus-thickness part and a vicinity of the pipe part between the inner mold and the outer mold, and rolling the screw-forming tool in the interposing state, in a circumferential direction of the pipe part while revolving in a left-hand direction (i.e., a counterclockwise direction) by seeing from the aperture end toward a bottom part of the intermediate-formed product so that a screw-thread part and a jaw part swelling outward around a lower part of the screw-thread part are formed on the intermediate-formed product; in which in the intermediate-formed product forming process, an outer diameter of the pipe part is formed to have an intermediate outer diameter between an outer diameter of a screw-ridge and an outer diameter of a screw-bottom of the screw-thread part after the screw-forming process; the screw-forming tool is provided to form larger clearances than a plate-thickness of the intermediate-formed product between the right-hand screw-type protrusion of the inner mold and a screw-bottom of the left-hand screw-type protrusion of the outer mold and between a screw-bottom of the right-hand screw-type protrusion of the inner mold and the left-hand screw-type protrusion of the outer mold in the interposing state in the screw-forming process; in the screw-thread part after the screw-forming process, an average height is set as "h" of the screw-ridge from the adjacent screw-bottom in a prescribed area including a maximum diameter part; a screw-starting part is set at a position of 0° in which a height of the screw-ridge from the adjacent screw-bottom is 0.5h above the screw-thread part; and a second-step starting part is set at a position of 360° from the screw-starting part; in the right-hand screw-type protrusion of the inner mold, a part forming the second-step starting part of the screw-thread part is set as a second-step-starting forming part; in the screw-forming process, the screw-forming tool and the intermediate-formed product are arranged so that a bend part between the tapered part and the pipe part in a vertical cross-section of the intermediate-formed product along a can-axis direction in the screw-starting part is arranged between a screw-ridge of the second-step-starting forming part of the inner mold and a screw-bottom above the screw-ridge; the screw-ridge is formed so that an outer diameter thereof is increased in a range of 360° from the screw-starting part to the second-step starting part, and so that a height of the screw-ridge from the adjacent screw-bottom is more than 0.5h and less than "h" in a range of 90° from the screw-starting part; and the screw-starting part is formed at an intermediate position of the tapered part of the intermediate-formed product, and the screw-thread part is formed from the tapered part to the pipe part.

According to the manufacturing method, by forming the screw-thread part of the bottle-can so that the outer diameter of the screw-ridge is increased in the range of 360° from the screw-starting part to the second-step starting part, that is, by setting the height of the first step to be lower than the heights of the second and subsequent steps of the screw-thread part, it is possible to reduce resistance of the cap putting on when resealing.

However, when the right-hand screw is formed on the screw-thread part, by rolling the screw-forming tool having the inner mold and the outer mold in the right-hand direction (i.e., a clockwise direction) by seeing from the aperture end toward the bottom part of the intermediate-formed product while revolving, the screw-ridge is formed from the upper part toward the lower part, so that material is gathered because the upper end near the aperture end is a free end. Accordingly, bending work is performed in a state in which tension is not effected enough, the height of the first step of the screw-ridge tends to become higher than a target height owing to spring-back.

On the other hand, if the screw-forming tool having the inner mold and the outer mold is revolved so as to be rolled in the left-hand direction (i.e., counterclockwise) by seeing from the aperture end toward the bottom part of the intermediate-formed product, since a lower end (i.e., the bottom part side) of the screw-forming part is fixed on the trunk part, the screw-thread part is formed so as to elongate material from the lower end side toward the aperture end part of the pipe part. That is to say, the bending work is performed in a state in which the tension is enough effected on the material at the screw-thread part of the intermediate-formed product, so that a shape of the screw-thread part is easy to follow a shape of the inner mold. As a result, according to the method of the present invention, it is possible to form the screw-thread part so that the height of the first step of screw-ridge is reliably lower than the height of the second and subsequent steps of the screw-ridge.

Moreover, in the present invention, the surplus-thickness part is formed on the intermediate-formed product around the lower part of the pipe part, and the jaw part is formed by swelling the surplus-thickness part in the screw-forming process. Therefore, the lower part of the pipe part is restrained by the screw-forming tool forming the jaw part, so that the screw-thread part can be formed in a state in which it is easy to effect the tension on the pipe part. Furthermore, since the surplus-thickness part is formed, an excessive tension is not effected on the lower part of the pipe part when forming the screw, and the material can be prevented from being damaged.

In the method described in Japanese Unexamined Patent Application, First Publication No. 2002-66674, the outer diameter of the pipe part before forming the screw-thread part is intermediate between the outer diameter of the screw-ridge and the outer diameter or the screw-bottom of the screw-thread part, and the screw-forming is performed at this position of the intermediate diameter. Accordingly, in the tapered part from the curl part to a first winding of the first step of the screw-ridge of the screw-thread part, especially in the part before the screw-starting part, a raw part having a larger outer diameter than an outer diameter of the screw-bottom part is remained. As a result, the raw part generates the resistance to resealing of the cap.

On the other hand, in the method according to the present invention, by forming the pipe part to have the outer diameter of the intermediate diameter between the outer diameter of the screw-ridge and the outer diameter of the screw-bottom of the screw-thread part, and by performing the screw-forming process so that the screw-starting part is formed at the intermediate position of the tapered part, the raw part is prevented from being enlarged than the outer diameter of the screw-bottom of the screw-thread part even if the raw tapered part is remained before the screw-starting part. Therefore, when the cap is resealed, it is possible to reduce the resistance of the cap while the cap is put on and the lowest end of the screw-thread inside the cap is introduced into the screw-bottom between the screw-starting part and the second step of the screw-ridge of the bottle-can.

In this case, because the pipe part before the screw-forming process is formed to have the outer diameter which is intermediate between the outer diameter of the screw-ridge and the outer diameter of the screw-bottom, plastic deformation volume is small in the screw-forming process. In the area of an angle-range of at least 90° circumferentially continuing from the screw-starting part formed on the tapered part, a part having a smaller outer diameter than the outer diameter intermediate between the outer diameter of the screw-ridge and the outer diameter of the screw-bottom is processed. This part is formed for a screw of the first step which is an incomplete-thread part, and the above aperture-end part is not molded; accordingly, a flow of the material is not restricted while processing.

In the manufacturing method of a bottle-can according to the present invention, because the larger clearance than the plate-thickness is provided between the inner mold and the outer mold when the screw-thread part is formed, a metal flow is excellent and the peeling of coatings (and the damages to the material) can be prevented.

As described above, in the present invention, the height of the first step is definitely lower than that of the second and subsequent steps in the screw-ridge of the screw-thread part, and the maximum diameter of the tapered part that is a part before the screw-starting part is not larger than the outer diameter of the screw-bottom; therefore, the resistance of the cap when resealing can be reduced.

It is presumed that the screw-bottom of the screw-thread part after forming has substantially a constant outer diameter, so there are cases in that: a difference of semi-diameters between the screw-ridge and the adjacent screw-bottom is called "a height" of the screw-ridge, the outer diameter of the screw-ridge is called "a ridge diameter", and the outer diameter of the screw-bottom is called "a bottom diameter".

In the manufacturing method according to the present invention, in a vertical cross-section along the can-axis direction at the screw-starting part, the screw-forming tool and the intermediate-formed product are arranged so that a bend part between the tapered part and the pipe part of the intermediate-formed product is arranged in a range between a screw-ridge of the second-step-starting part and the above screw-bottom of the inner mold. As a result, the maximum outer diameter of the tapered part which is not deformed above the screw-ridge can be set to be equal to or smaller than the bottom diameter of the screw-thread part.

In the manufacturing method of the screw-threaded bottle-can according to the present invention, it is preferable that the tapered part have an angle of 10° to 30° with respect to the can-axis direction.

In the manufacturing method of the screw-threaded bottle-can according to the present invention, it is preferable to have a curling process forming a curl part at an upper part than the screw-thread part by folding back and rounding the aperture-end part and crushing radially inward after the screw-forming process. When the screw-thread part is formed from the lower end side toward the aperture end, if rigidity of the aperture end is high, it may be obstructed to form the screw-thread part. Therefore, it is preferable that the curl part for improving the rigidity of the aperture end be formed after forming the screw-thread part.

Effects of the Invention

According to the present invention, since the screw-thread part is formed with enough tension, it can be prevented that the height of the first step becomes larger than the height of the second and subsequent steps in the screw-ridge of the screw-thread part, and the tapered part before the screw-starting part at the first step of the screw-thread part is restricted not to be larger than the outer diameter of the screw-bottom of the screw-thread part, so that it is easy to perform resealing. Moreover, the plastic deformation volume by the screw-forming process is small, and the restriction of the material flow when forming is small in the process of the first step of the screw-ridge; accordingly, the damage to the inner coat can be restricted.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Below, an embodiment of the present invention will be described.

Figure 1:
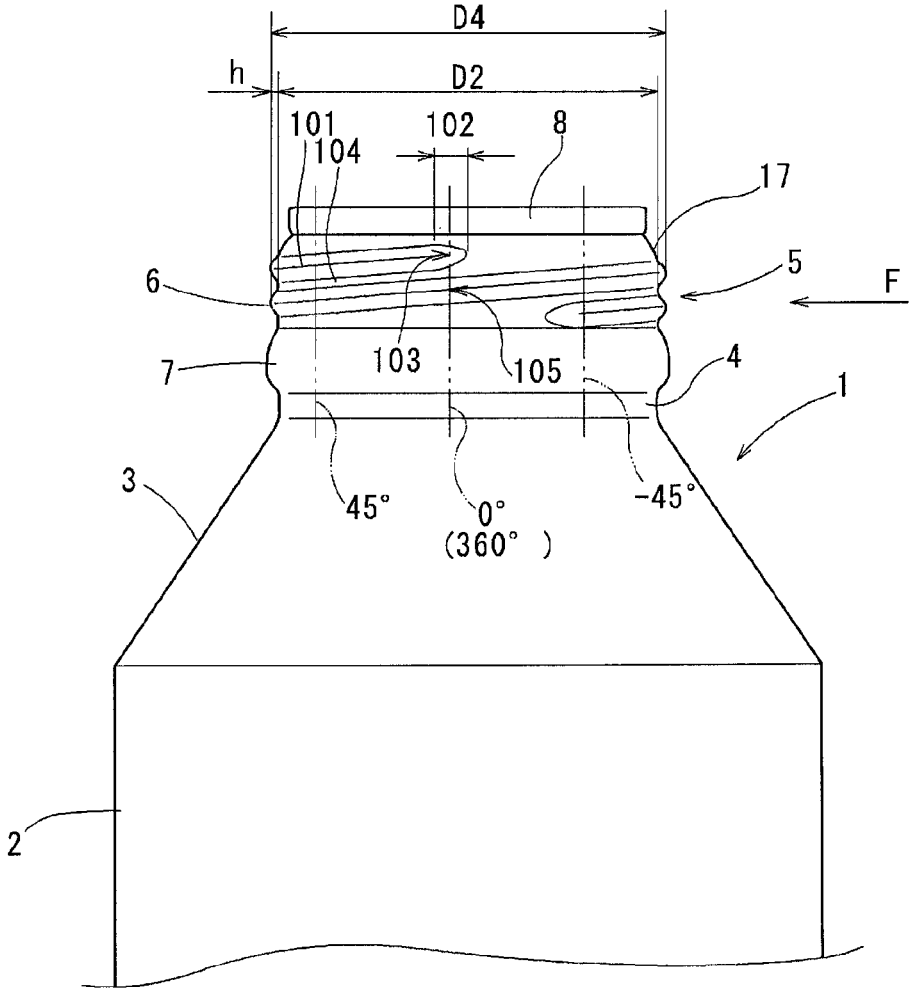
FIG. 1 is a frontal view showing an upper half of a bottle-can in an embodiment according to the present invention.

A bottle-can 1 is made from an aluminum or aluminum alloy thin-plate metal: and as shown in FIG. 1, a shoulder part 3 which is tapered upward; a neck part 4 of a cylindrical shape with a small diameter extending upward from an upper end of the shoulder part 3; and a mouth section 5 on an upper end of the neck part 4; are formed on a trunk part 2 of a closed-end cylindrical shape. The mouth section 5 has: a screw-thread part 6 formed on a periphery thereof; a jaw part 7 formed below the screw-thread part 6 for fixing a skirt-end part of a cap; and a curl part 8 formed above the screw-thread part 6.

Figure 2:
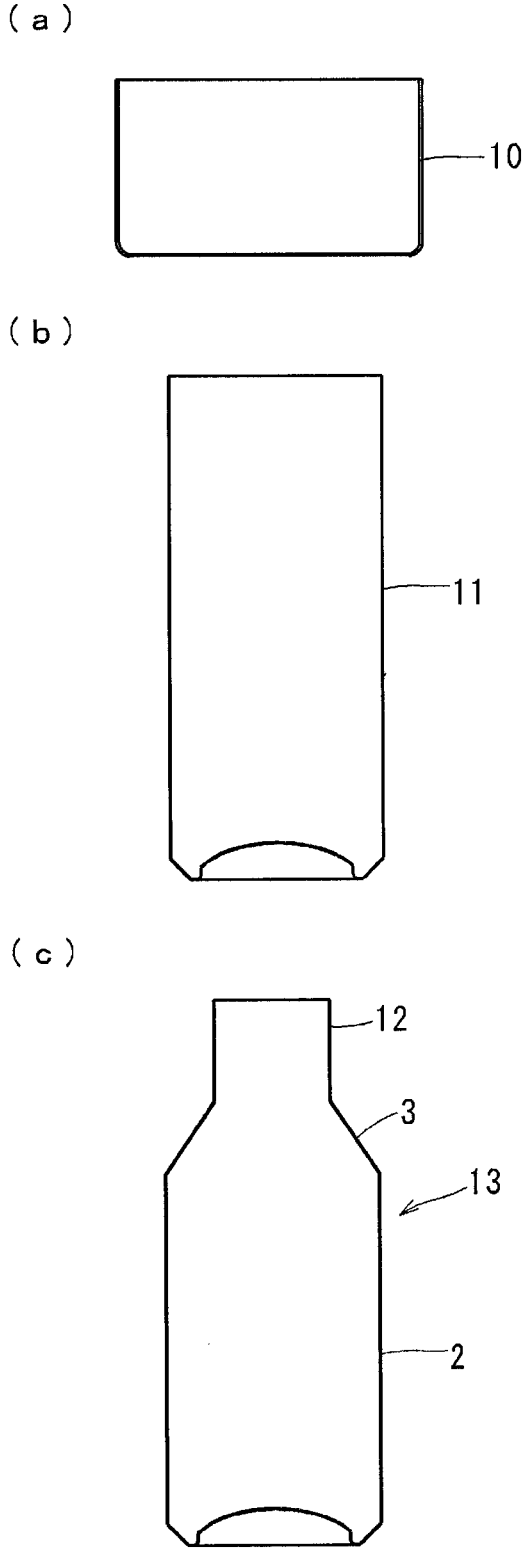
FIG. 2 is a cross-sectional view showing early stages of manufacturing processes of the bottle-can from (a) to (c) in order.

When manufacturing the bottle-can 1, a shallow cup 10 having a relatively large diameter is formed as shown in a part (a) of FIG. 2 by punching an aluminum-plate material and drawing it, then the drawing for a second time and ironing (i.e., DI process) are performed on the cup 10 so as to form a cylindrical body 11 having a prescribed height as shown in a part (b) of FIG. 2, and an upper end is trimmed by trimming. By this DI process, a bottom part of the cylindrical body 11 is formed to have a bottom-part shape as an end product of the bottle-can 1.

Figure 5:
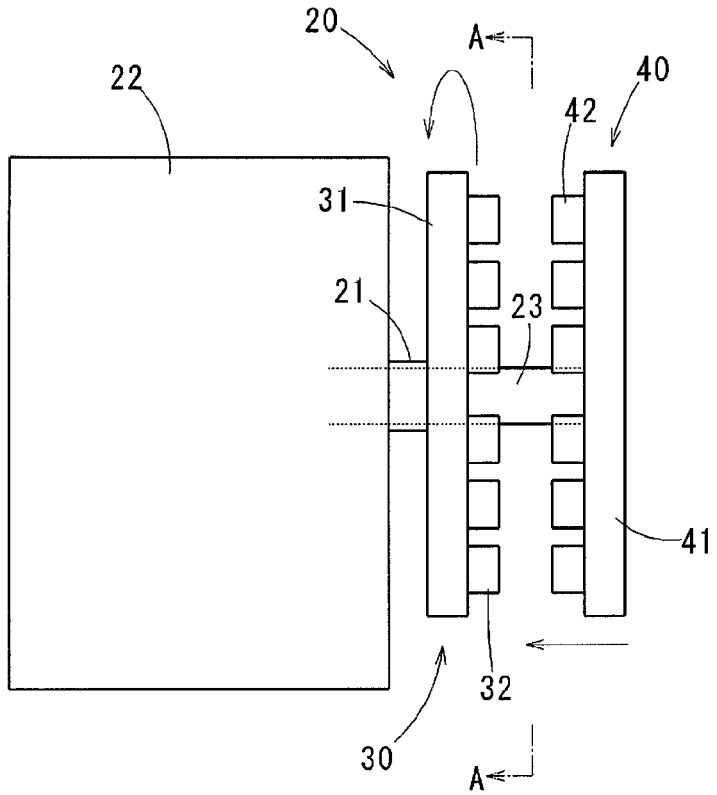
FIG. 5 is a frontal view schematically showing a manufacturing apparatus of a bottle-can.
Figure 6:
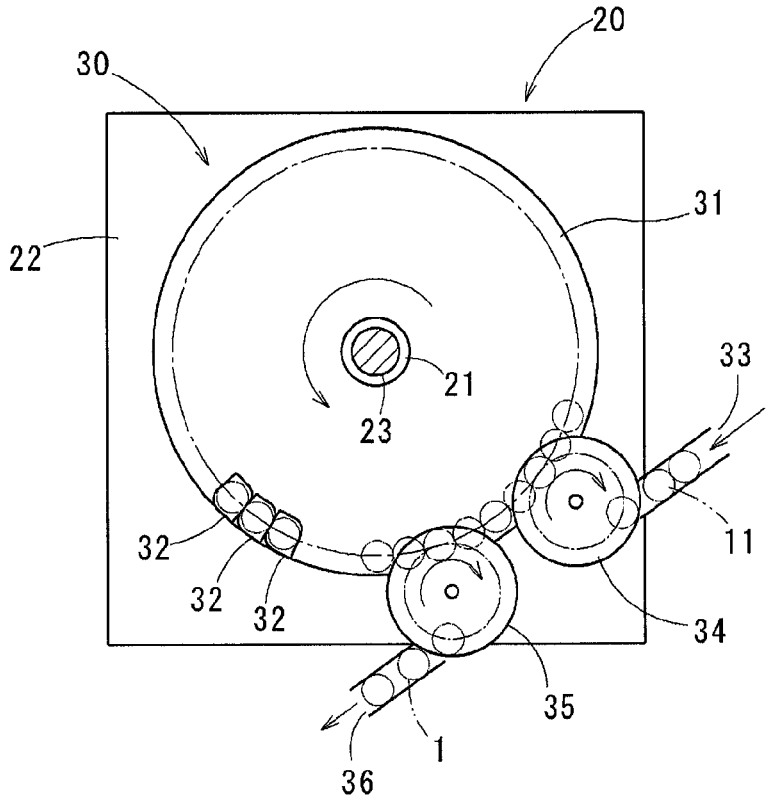
FIG. 6 is an arrow view taken along the line A-A in FIG. 5.

Next, the bottle-can 1 is manufactured by a manufacturing apparatus 20 of bottle-can shown in FIG. 5 and FIG. 6. A manufacturing apparatus 20 of bottle-can will be described below. The manufacturing apparatus 20 of bottle-can processes the cylindrical body 11 formed as above into the bottle-can 1 of a final shape, so that a shape of a can is transformed along with progress of the processing. Below, the can will be explained as a closed-end cylindrical body W in the process from the cylindrical body 11 to the bottle-can 1 when the shape of the can is not especially limited.

The manufacturing apparatus 20 of bottle-can is provided with: a work-holding unit 30 holding a plurality of the closed-end cylindrical bodies W; a tool-holding unit 40 holding a plurality of forming tools 42 performing various forming processes on the closed-end cylindrical bodies W; and a driving device 22 driving the holding units 30 and 40. A work-holding side of the work-holding unit 30 holding the closed-end cylindrical bodies W and a tool-holding side of the tool-holding unit 40 holding the forming tools 42 are arranged so as to be opposed.

The work-holding unit 30 has a structure in which a plurality of holders 32 holding the closed-end cylindrical bodies W are arranged in a circular manner along a circumferential direction on a surface opposite to the tool-holding unit 40 in a disk 31 held on a supporting shaft 21. The disk 31 is intermittently rotated around the supporting shaft 21 by the driving device 22, so that the closed-end cylindrical bodies W which are supplied from a supplying part 33 through a supplying star wheel 34 each are held by the holder 32 and carried along a circumferential direction of the disk 31. The closed-end cylindrical body W is formed by the forming tools 42 of the tool-holding unit 40 while being carried by the disk 31, and then ejected in series to an ejecting part 36 through an ejecting star wheel 35 as the bottle-can 1 after forming.

The holders 32 each are provided with a pad part 37 being in contact with a bottom surface of the closed-end cylindrical body W; and a ring part 38 having an air chuck or the like which can hold an outer circumferential surface of the bottom part (refer to FIG. 9), and hold the closed-end cylindrical body W by holding a part from the bottom part to a lower part of the trunk part in the can-axis direction of the closed-end cylindrical body W. In FIG. 5, some of the plurality of the holders 32 provided in an entire circumference of the disk 31 is illustrated, but the remaining holders 32 are omitted from the drawing.

The closed-end cylindrical body W is supplied to the supplying part 33 as the cylindrical body 11 formed by the DI forming, and with deforming by the process becomes the bottle-can 1 of the final shape at the ejecting part 36.

The tool-holding unit 40 has a structure in which the various forming tools 42 are arranged in a circular manner along a circumferential direction on a surface opposite to the work-holding unit 30 in a disk 41 held on a supporting shaft 23, and the disk 41 is advanced and retreated along a shaft direction of a supporting shaft 23 by the driving device 22. The supporting shaft 23 is provided in and coaxially with the supporting shaft 21.

The tool-holding unit 40 is provided with the plurality of the forming tools 42 for processing in accordance with the processing steps, such as: a plurality of shoulder-necking dies for reducing a diameter of an aperture part of the closed-end cylindrical body W (i.e., the neck-in process); a shaping die for forming a pipe part 18 as described below by reducing a diameter of the aperture part after expanding a diameter in part that was previously reduced; a mouth-necking die for forming a tapered part 17 and an aperture-end part 16 above the pipe part 18; a screw-forming tool for forming the screw-thread part 6; a curl-forming tool for forming a curl part 8, and the like. These forming tools 42 are arranged in a circular manner along the circumferential direction on the disk 41 in processing order.

The work-holding unit 30 (the disk 31) in which an axis of the supporting shaft 21 is a rotation center is set to have an intermittent-rotation stop position so that can-axes of the closed-end cylindrical bodies W in which the aperture parts are opposite to the tool-holding unit 40 are coincident with center axes of the forming tools 42 respectively. By the intermittent rotation of the disk 31 by the driving device 22, the closed-end cylindrical bodies W are each carried by rotation to an opposite position to the forming tool 42 for the next process and performed the process of the next step.

That is to say, the work-holding unit 30 is carried with rotation so that the forming tools 42 perform processes on the closed-end cylindrical bodies W in accordance with the processes when the tool-holding unit 40 is advanced and approaches the work-holding unit 30, and so that the forming tools 42 of the next processes are opposite to the closed-end cylindrical bodies W when the holding units 30 and 40 are away from each other. By repeating such movements in which the holding units 30 and 40 approach each other and the process is performed and then are receded and rotated, the shoulder part 3, the screw-thread part 6 and the like are formed on the closed-end cylindrical body W, so that the bottle-can 1 is manufactured.

These forming tools 42 each perform the process on the respective closed-end cylindrical bodies W held on the work-holding unit 30 when the tool-holding unit 40 is advanced to left in FIG. 5 toward the work-holding unit 30. Below, these forming tools are described by the reference symbol 42 when it is not limited as a specific tool.

Next, a manufacturing method of the bottle-can 1 will be described in processing order along with a description of a detailed structure of the manufacturing apparatus 20 of bottle-can.

Figure 3:
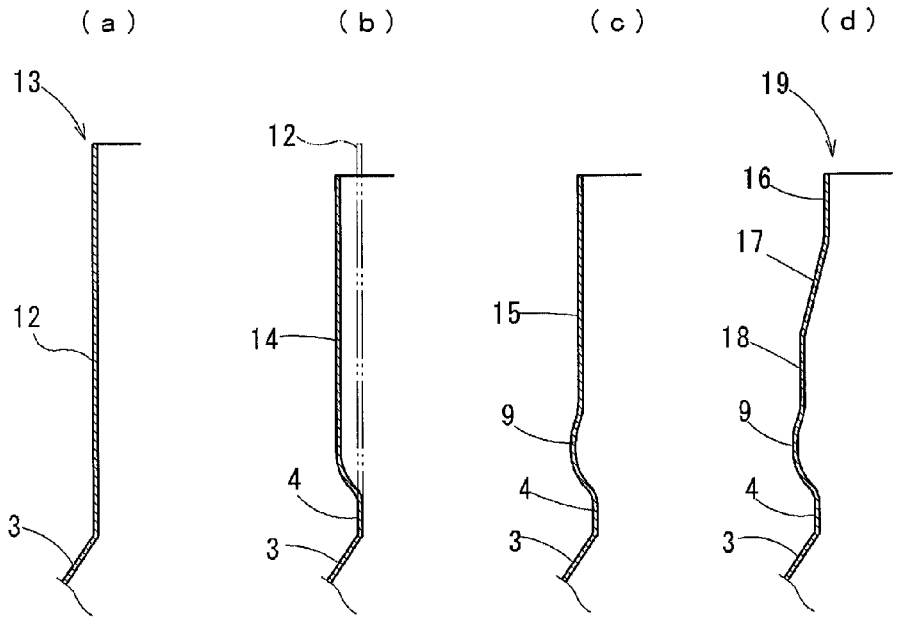
FIG. 3 is a cross-sectional view of a principal part showing forming processes of an intermediate-formed product from (a) to (d) in order.

A thin plate made of aluminum alloy or the like is formed to a state of the cylindrical body 11 shown in a part (b) of FIG. 2 by the drawing and the ironing (the DI process); an upper part of the cylindrical body 11 is reduced in a diameter as shown in a part (c) of FIG. 2; and an intermediate-formed body before a screw-forming process is manufactured in processing order shown in FIG. 3.

Specifically, at first, an aperture part of the cylindrical body 11 is reduced in a diameter gradually by a die-necking process sequentially using the plurality of the forming tools 42 arranged along a circumferential direction on the tool-holding unit 40, and then, as shown in the part (c) of FIG. 2 and a part (a) of FIG. 3, the shoulder part 3 and a cylindrical small-diameter part 12 to be extended upward from the shoulder part 3 are formed, so that a stepped-formed product 13 is produced. In order to form the shoulder part 3 and the small-diameter part 12, the plurality of the forming tools 42 are provided to have a same basic structure though a diameters before and after the processes are different; and the forming tools 42 carry the closed-end cylindrical bodies W to the adjacent forming tools 42 and sequentially process them. A series of the forming tools 42 for forming the shoulder part 3 and the small-diameter part 12 are designated as the shoulder-necking dies.

Figure 7:
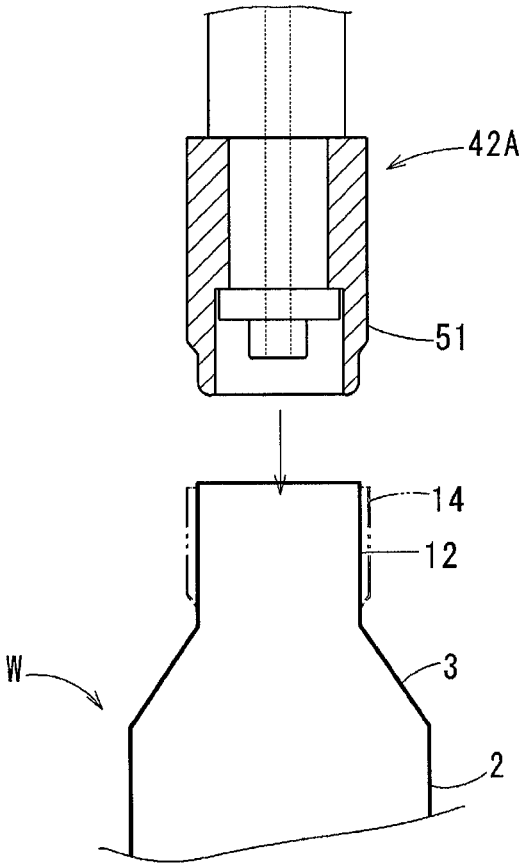
FIG. 7 is a cross-sectional view showing a punch enlarging a diameter of a small-diameter part of a stepped-formed product.

Next, as shown in a part (b) of FIG. 3, the small-diameter part 12 is expanded in the diameter again from a position slightly above an upper end of the shoulder part 3, except for a lower-end part, so that a large-diameter part 14 is formed. A forming tool 42A for this case has a diameter-expansion punch 51 at a top end thereof as shown in FIG. 7, and is press-inserted into the small-diameter part 12 which is reduced in the diameter in a state shown in the part (a) of FIG. 3, so that the small-diameter part 12 is expanded in the diameter to form the large-diameter part 14 in a length-range of being inserted. By the process of the large-diameter part 14, a part which is not expanded in a diameter at the lower-end part of the small-diameter part 12 becomes the neck part 4.

Next, as shown in a part (c) of FIG. 3, except for a lower-end part of the large-diameter part 14, a part above the lower-end part is reduced in the diameter again so that a reduced-diameter part 15 is formed. The process in this case is a die-necking process as in a case shown in the part (a) of FIG. 3.

Figure 8:
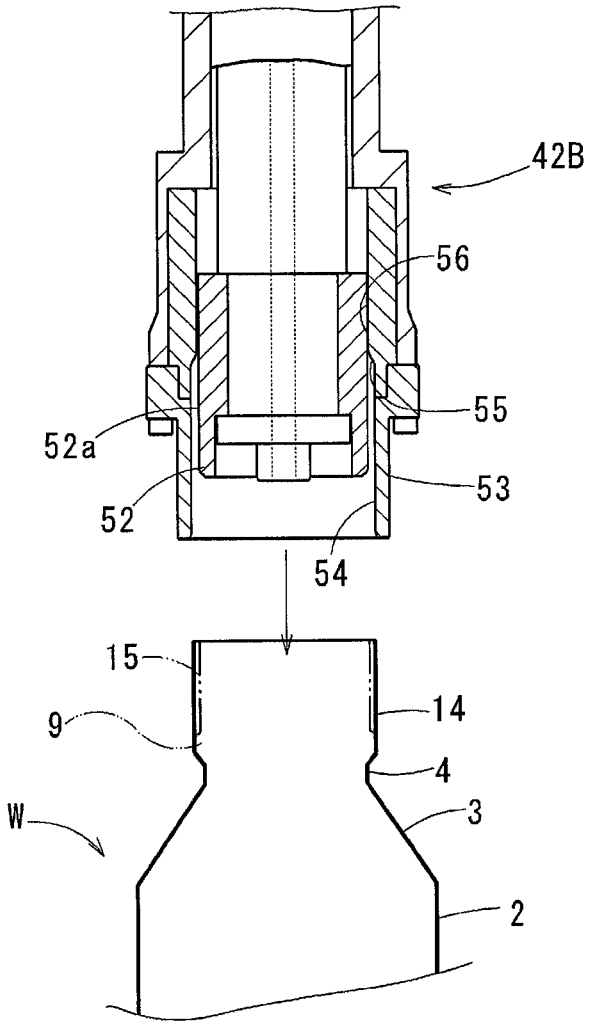
FIG. 8 is a cross-sectional view showing a forming tool for a die-necking process reducing a diameter of a large-diameter part formed in the process shown in FIG. 7.

FIG. 8 shows a forming tool 42B which is used in the die-necking process. The forming tool 42B is provided with: an inner die 52 which is inserted into the closed-end cylindrical body W (in this case, the cylindrical body 11); and an outer die 53 which is arranged outer of the inner die 52. An outer diameter of the inner die 52 is smaller than an inner diameter of an aperture part of the closed-end cylindrical body W before processing and formed to an outer diameter after reducing the diameter. On inner circumferential surface of the outer die 53: a guide surface 54 having an inner diameter into which the aperture part of the closed-end cylindrical body W before processing is inserted; a tapered surface 55 for a drawing process reducing a diameter of the aperture part; and a small-diameter surface 56 forming a gap into which the aperture part which is reduced in the diameter is inserted between an outer circumferential surface 52*a* of the inner die 52, are formed in order from an end.

Then, by press-inserting the aperture part of the closed-end cylindrical body W held by the work-holding unit 30 along the guide surface 54 into the outer die 53, the aperture-end part of the closed-end cylindrical body W is reduced in a diameter so as to follow the tapered surface 55 of the outer die 53 and is inserted between the outer circumferential surface 52*a* of the inner die 52 and a small-diameter surface 56 of the outer die 53. The forming tool 42 which is used for the process shown in the part (a) of FIG. 3 is provided with a plurality of pairs of inner dies and outer dies having a same structure though the diameters are different from that of the forming tool 42B shown in FIG. 8.

By this process on the reduced-diameter part 15, a part which is not processed below the reduced-diameter part 15 becomes a surplus-thickness part 9. In this case, the reduced-diameter part 15 is formed to have a larger diameter than that of the neck part 4 that is an intermediate outer diameter between an outer diameter of a screw-bottom and an outer diameter of a screw-ridge of the screw-thread part 6 described below. The outer diameter of the reduced-diameter part 15 is set in accordance with an inner diameter of the small-diameter surface of the outer die. In this embodiment, the surplus-thickness part 9 is provided so as to be swelled out as a protrusion streak round an upper end of the neck part 4; however, the surplus-thickness part 9 may be provided as a recessed groove which is swelled inward.

Here, the forming tools 42A and 42B are named shaping dies that form the stepped-formed product 13 shown in the part (a) of FIG. 3 into the state shown in the part (c) of FIG. 3 and form an outer diameter of the reduced-diameter part 15 which becomes the below-mentioned pipe part 18 to an outer diameter intermediate between the outer diameter of the screw-bottom and the outer diameter of the screw-ridge of the screw-thread part 6 of the bottle-can 1.

Next, as shown in a part (d) of FIG. 3, the aperture-end part 16 which is reduced in a diameter and a connected tapered part 17 are formed by reducing a diameter of the reduced-diameter part 15 toward an upper end at upper half. Also in this case, it is a die-necking process as shown in the part (a) of FIG. 3 and the part (c) of FIG. 3, pairs of inner dies and outer dies having same structures though the diameters are different from that of shown in FIG. 8 are used for the forming tool 42. By processing of the aperture-end part 16 and the tapered part 17, a lower part which is not processed becomes the pipe part 18, so that an intermediate-formed product 19 is produced. The pipe part 18 is formed to have a thickness of 0.25 to 0.4 mm.

Here, the forming tool forming the tapered part 17 and the aperture-end part 16 having the reduced diameter at the end side of the pipe part 18 is named a mouth-necking die. A can-upper forming structure is configured from the above-mentioned shoulder-necking dies, the shaping dies (the forming tools 42A and 42B), the mouth-necking die, and the driving device 22 driving them.

Figure 4:
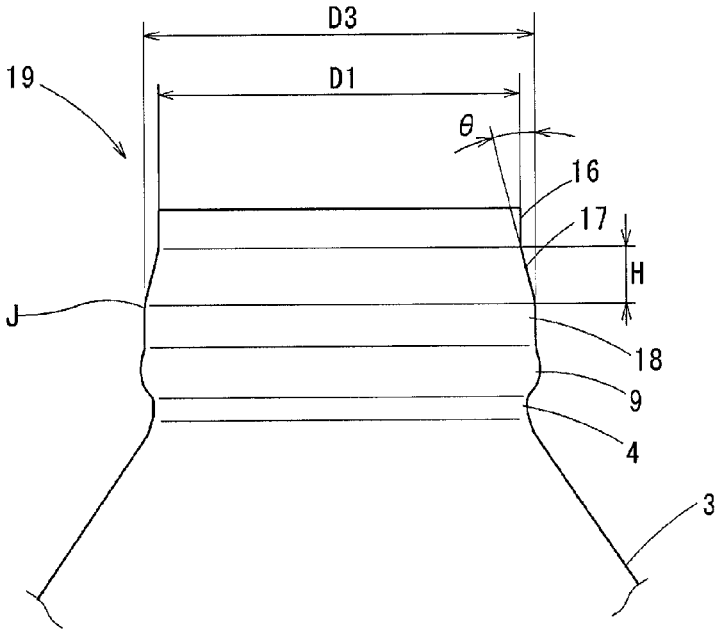
FIG. 4 is a frontal view showing a vicinity of a pipe part of the intermediate-formed product.

In a series of the manufacturing processes, as shown also in FIG. 4, the intermediate-formed product 19 has: the aperture-end part 16 which is formed to have a straight shape having a necessary length from the upper end for forming the curl part 8; the tapered part 17 gradually expanding in the diameter downward from the lower end of the aperture-end part 16; and the pipe part 18 formed at the lower end of the tapered part 17. The pipe part 18 is formed in a straight cylindrical shape; and at the lower-end part of the pipe part 18, the surplus-thickness part 9 having an outer diameter larger than the pipe-part 18 is formed. At the lower end of the surplus-thickness part 9, the neck part 4 which is reduced in the diameter, and the shoulder part 3 which is expanded in the diameter from the lower end of the neck part 4 are serially formed.

In the intermediate-formed product 19, an outer diameter D1 of the aperture-end part 16 is set to be smaller than a bottom diameter D2 of a screw-bottom of the screw-thread part 6 to be formed. An outer diameter D3 of the pipe part 18 is set to an intermediate diameter between a ridge diameter D4 and the bottom diameter D2. For example, if the ridge diameter D4 is 37 mm, the bottom diameter D2 is 36.3 mm, and a gap between a first step and a second step of the screw-thread is 2.5 mm to 4.5 mm, the outer diameter D3 of the pipe part 18 is set to 36.5 mm to 36.8 mm. The tapered part 17 connecting the pipe part 18 and the aperture-end part 16 is set to have an inclined angle θ of 10° to 30° with respect to the can-axis direction and a length H along the can-axis direction of 2.0 to 6.0 mm.

Figure 9:
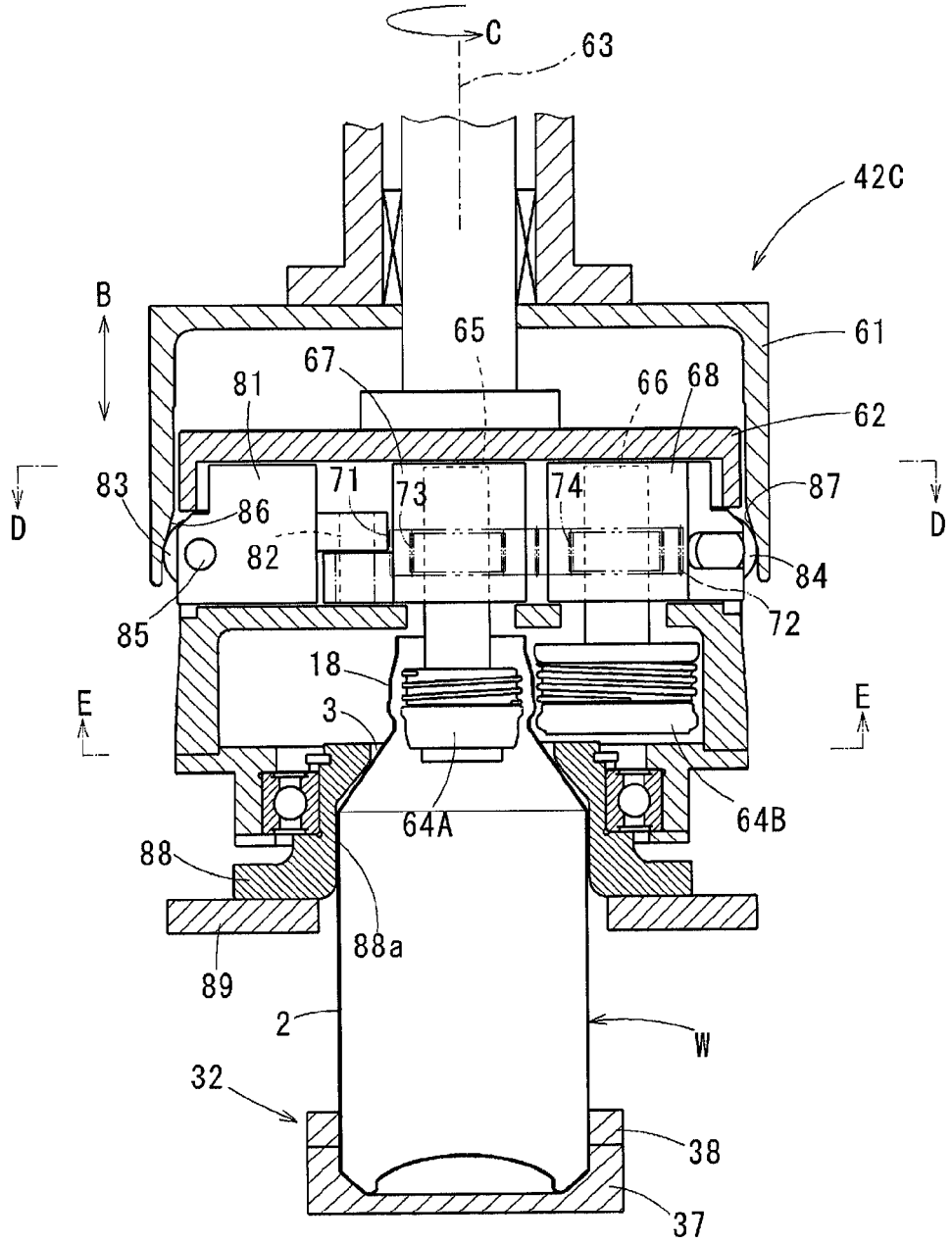
FIG. 9 is a cross-sectional view showing a screw-forming tool.
Figure 10:
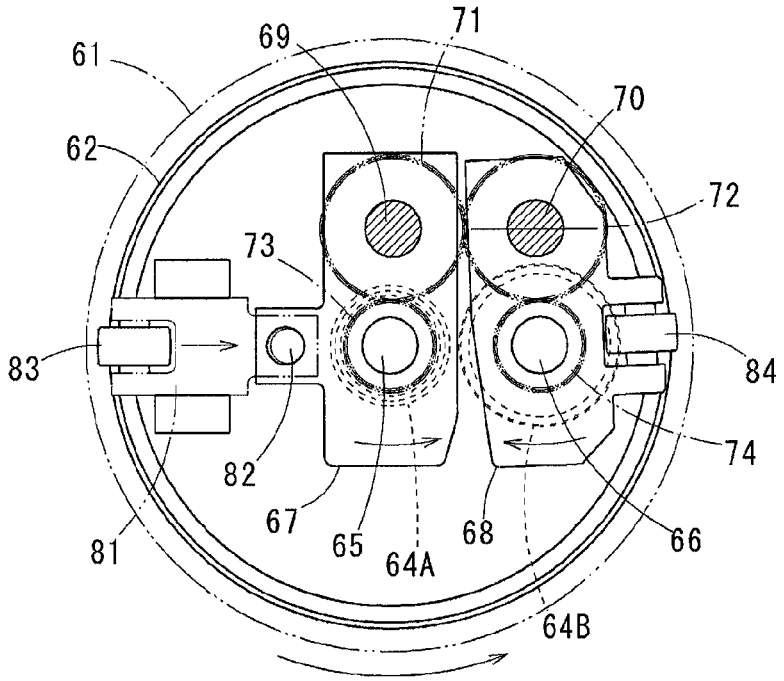
FIG. 10 is an arrow view taken along the line D-D in FIG. 9 from an aperture end toward a bottom part.
Figure 11:
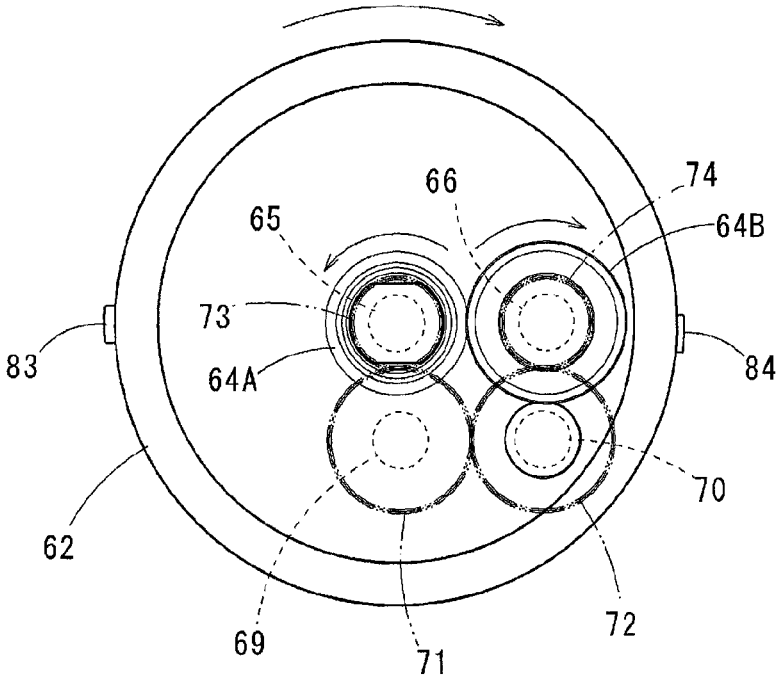
FIG. 11 is an arrow view taken along the line E-E in FIG. 9 from the bottom part toward the aperture end.

Next, the screw-thread part 6 is formed by using screw-forming tools shown in FIG. 9 to FIG. 11.

A screw-forming tool 42C forming the screw-thread part 6 has: a first housing 61 mounted on the disk 31; and a second housing 62 installed on so as to move back and forth to the first housing 61 as shown by an arrow B in FIG. 9. The screw-forming tool 42C as a whole is rotationally driven by the driving device 22 around a revolution axis 63 as shown by an arrow C.

The second housing 62 is held with being pushed toward a top-end side (i.e., downward in FIG. 9) to the first housing 61 by an energizing member which is not illustrated, and therein is provided with: an inner mold 64A being in contact with an inner circumferential surface of the pipe part 18 of the closed-end cylindrical body W and an outer mold 64B being in contact with an outer circumferential surface of the pipe part 18 of the closed-end cylindrical body W.

Figure 13:
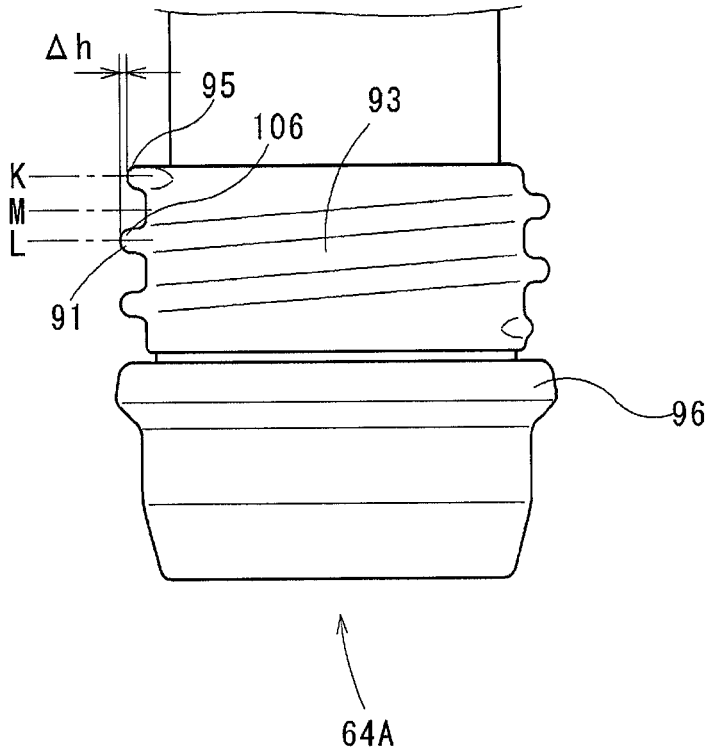
FIG. 13 is a frontal view showing an inner mold of the screw-forming tool in a state in which a screw-starting forming part is arranged on a left-end side.
Figure 14:
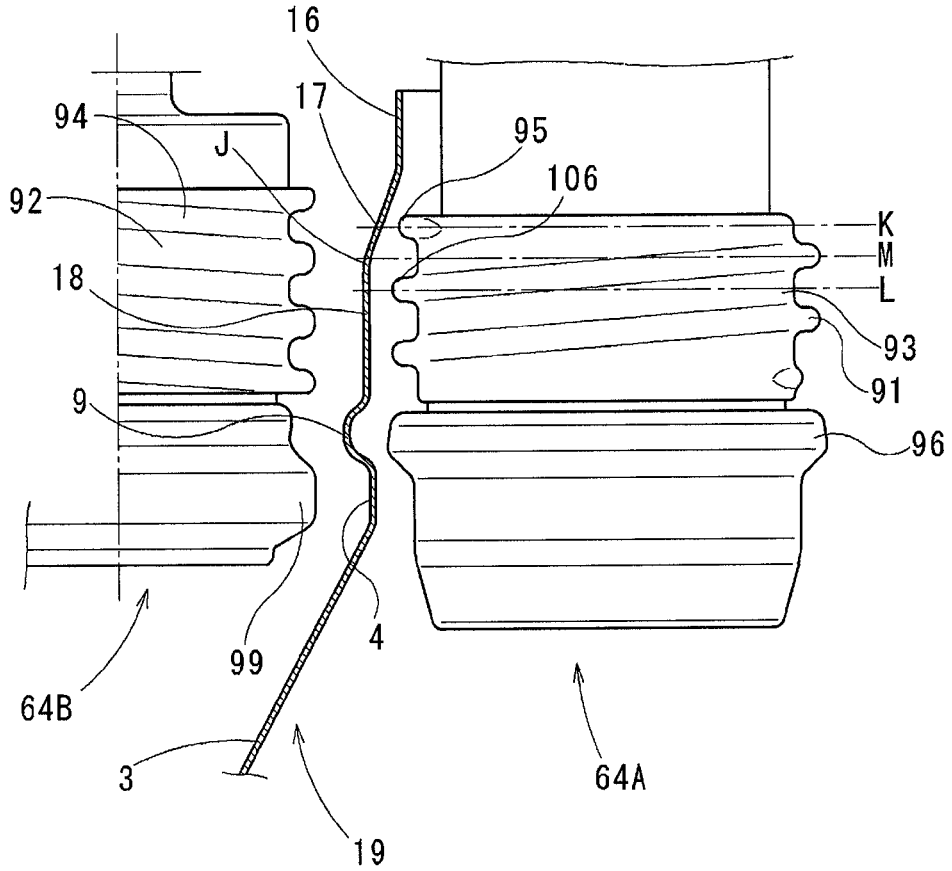
FIG. 14 is a vertical-sectional view showing the intermediate-formed product taken along a can-axis direction at a screw-starting part of a screw-thread part in a state in which the inner mold and an outer mold of the screw-forming tool is arranged so as to interpose the pipe part of the intermediate-formed product therebetween.
Figure 15:
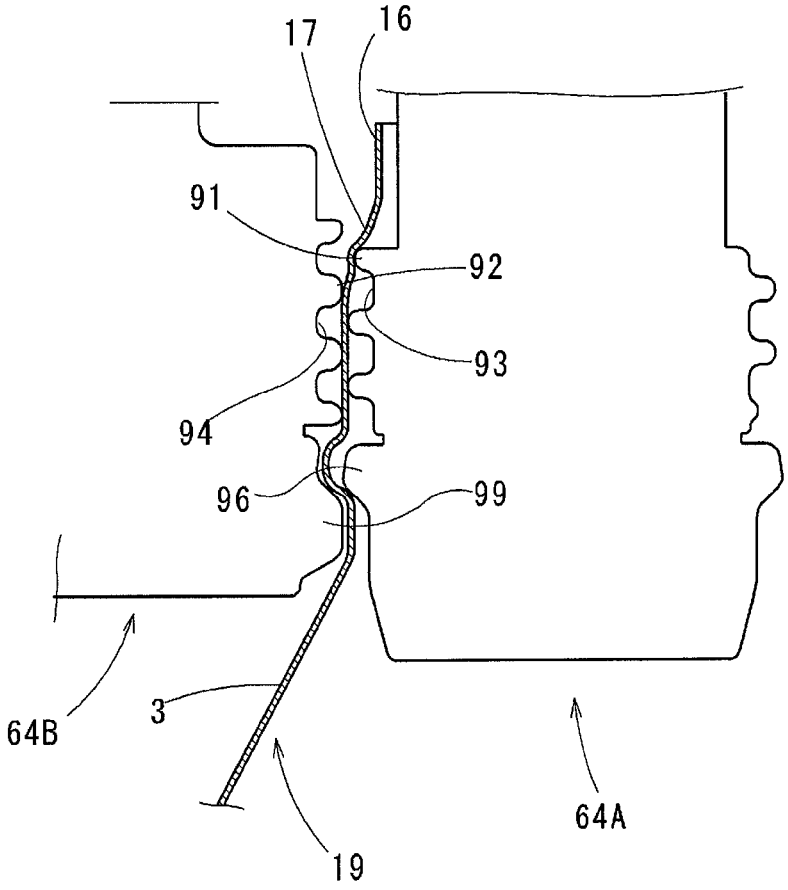
FIG. 15 is a vertical-sectional view of the intermediate-formed product showing a state in which the inner mold is in contact with the pipe part of the intermediate-formed product.
Figure 16:
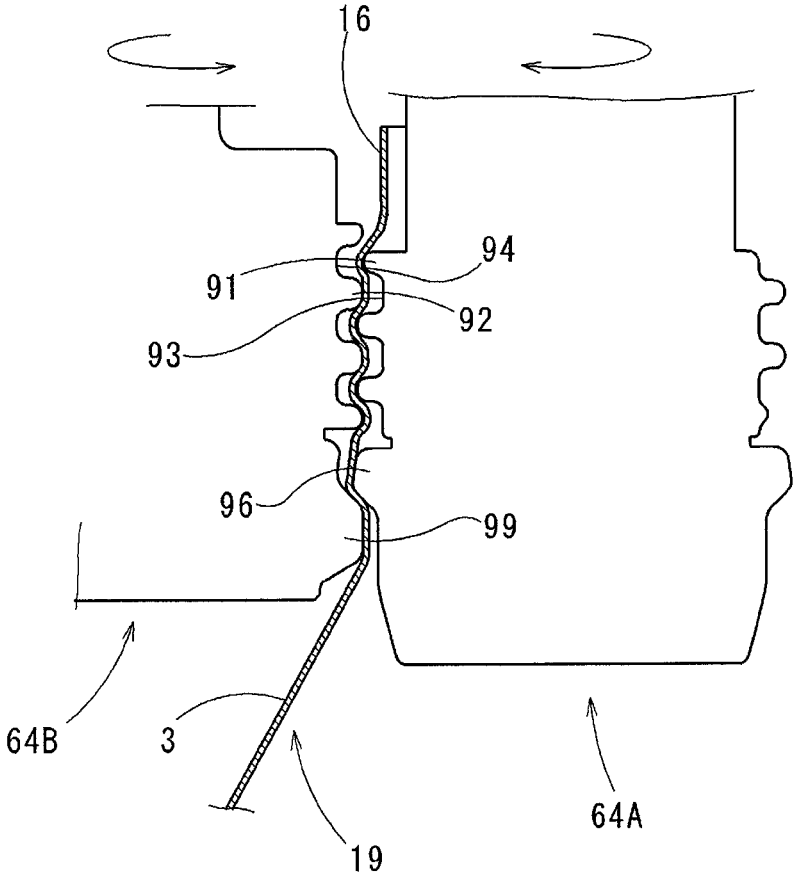
FIG. 16 is a vertical-sectional view of the intermediate-formed product showing a state in which the pipe part of the intermediate-formed product is interposed between the inner mold and the outer mold.

As shown in FIG. 13, the inner mold 64A has: a protrusion and a recess of a right-hand screw-type (a screw-forming protrusion 91 and a screw-forming recess 93) for forming the right-hand-type screw-thread part 6 at a top end of an outer circumferential surface in substantially a columnar shape; and an inner-mold swell part 96 for forming the jaw part 7, and is held rotatably around a shaft 65. In the screw-forming protrusion 91 of the inner mold 64A, a part forming a screw-starting part 103 of the screw-thread part 6 of the bottle-can 1 is named as a screw-starting forming part 95, and a part forming a second-step starting part 105 of the screw-thread part 6 is named as a second-step-starting forming part 106. FIG. 14 to FIG. 16 are arrow views showing processes of forming the bottle-can 1 by seeing in a direction of an arrow F in FIG. 1. The intermediate-formed product 19 in FIG. 14 to FIG. 16 is shown by a cross-section at a position of 0° shown in FIG. 1.

As shown in FIG. 14, the outer mold 64B has: a protrusion and a recess of a left-hand screw-type (a screw-forming protrusion 92 and a screw-forming recess 94) for forming the right-hand-type screw-thread part 6 at a top end of an outer circumferential surface in substantially a columnar shape; and an outer-mold swell part 99 for forming the jaw part 7, and is held rotatably around a shaft 66.

The shaft 65 of the inner mold 64A is rotatably kept in a block body 67 which is a gear box at a same time. The block body 67 is held so as to be freely swung in an orthogonal direction to the shaft 65 around a supporting shaft 69 in the second housing 62. The shaft 66 of the outer mold 64B is rotatably kept in a block body 68 which is a gear box at a same time. The block body 68 is held so as to be freely swung in an orthogonal direction to the shaft 66 around a supporting shaft 70 in the second housing 62.

A gear 71 is provided on the supporting shaft 69 of the block body 67. A gear 72 is provided on the supporting shaft 70 of the block body 68. The gear 71 and the gear 72 are engaged each other. A gear 73 is provided on the shaft 65 of the inner mold 64A. A gear 74 is provided on the shaft 66 of the outer mold 64B. These gears 71 to 74 are engaged sequentially.

Specifically, the gear 73 of the inner mold 64A, the gear 71 in the block body 67 keeping the inner mold 64A, the gear 72 in the other block body 68, and the gear 74 of the outer mold 64B kept in the block body 68 are engaged in order. The gear 71 in the block body 67 keeping the inner mold 64A is connected to the driving device 22; by driving the gear 71 (a driving gear), the inner mold 64A and the outer mold 64B are synchronously rotated. The block bodies 67 and 68 can be swung in the orthogonal direction to the shafts 65 and 66 around the supporting shafts 69 and 70 respectively in a state in which the gears 71 and 72 of the block bodies 67 and 68 are maintained to a state of engaging.

Synchronized rotation of the inner mold 64A and the outer mold 64B is set so that a number of rotation of the inner mold 64A is an integral multiple of a number of rotation of the outer mold 64B; for example, when the outer mold 64B is rotated one round, the inner mold 64A is rotated one round, or two or three rounds.

With respect to the inner mold 64A and the outer mold 64B, as shown by arrows in FIG. 11, by seeing from a lower end side of the screw-forming tool 42C, while the inner mold 64A is rotated counterclockwise (left-hand rotation) and the outer mold 64B is rotated clockwise (right-hand rotation), the screw-forming tool 42C having the inner mold 64A and the outer mold 64B is revolved clockwise (in right-hand revolution) around the revolution axis 63 by the second housing 62. In other words, seeing from the aperture end toward the bottom part of the closed-end cylindrical body W, the inner mold 64A is rotated in the right-hand direction, the outer mold 64B is rotate in the left-hand direction, and the screw-forming tool 42C including the inner mold 64A and the outer mold 64B is revolved in the left-hand direction.

A screw-tool rotation structure is configured from the gears 71 to 74 and the driving device 22.

The block body 67 holding the inner mold 64A is connected with an assistance-block body 81 via a shaft 82. The assistance-block body 81 is held in the second housing 62 movably along a direction orthogonal to the shaft 65 of the inner mold 64A and the shaft 66 of the outer mold 64B. A cam roller 83 is rotatably held by a shaft 85 orthogonal to a moving direction of the second housing 62 on an outer side part of the assistance-block body 81. A cam roller 84 is rotatably held by the shaft 85 orthogonal to the moving direction of the second housing 62 on an outer side part of the block body 68 holding the outer mold 64B.

The cam rollers 83 and 84 are in contact with cam faces 86 and 87 of an inner face of the second housing 62 respectively. The cam rollers 83 and 84 move in a radial direction of the second housing 62 in accordance with transition of relative positions of the first housing 61 and the second housing 62 by the driving device 22. When the cam rollers 83 and 84 are pushed into the second housing 62 by the cam faces 86 and 87 on the inner surface of the second housing 62 as shown by arrows in FIG. 10, the inner mold 64A and the outer mold 64B approach each other so that a wall of the pipe part 18 of the closed-end cylindrical body W can be put between the recess and the protrusion on outer surfaces of the inner mold 64A and the outer mold 64B and deformed.

A screw-tool gripping structure is configured from the cam rollers 83 and 84, the cam faces 86 and 87 of the second housing 62, and the driving device 22. Furthermore, a screw-thread forming structure is configured from the above-mentioned screw-tool rotation structure and this screw-tool gripping structure.

On an end of the second housing 62, a ring member 88 having a cylindrical face 88*a* along the trunk part 2 of the closed-cylindrical body W is rotatably provided. Meanwhile, on a side of the work-holding unit 30, a stopper member 89 is provided. When the tool-holding unit 40 (the screw-forming tool 42C) advances toward the closed-end cylindrical body W, by bringing the ring member 88 into contact with the stopper member 89, a most forward position of the second housing 62 is settled to the closed-end cylindrical body W.

Next, it will be described in detail that a detailed structure of the inner mold 64A and the outer mold 64B of the screw-forming tool 42C and a forming process of the screw-thread part 6 on the pipe part 18 of the intermediate-formed product 19 using the screw-forming tool 42C.

On outer circumferential surfaces of the inner mold 64A and the outer mold 64B, as shown in FIG. 13 and FIG. 14, the screw-forming protrusions 91 and 92 and the screw-forming recesses 93 and 94 for forming the screw-thread part 6 of the right-hand type on the pipe part 18 of the intermediate-formed product 19 are formed spirally and in shapes corresponding to each other. The inner mold 64A and the outer mold 64B are mutually approached as described above; the surplus-thickness part 9 is put between the inner-mold swell part 96 and the outer-mold swell part 99; the pipe part 18 of the intermediate-formed product 19 is put between the mutual protrusion-and-recess; and the inner mold 64A and the outer mold 64B are revolved around the axis of the intermediate-formed body 19, so that the screw-thread part 6 is formed on the pipe part 18 and the surplus-thickness part 9 is deformed into the jaw part 7. The screw-forming protrusion 91 of the inner mold 64A is formed as a right-hand screw-type (hereinafter, it is named a right-hand screw-type protrusion 91), the screw-forming protrusion 92 of the outer mold 64B is formed as a left-hand screw-type (hereinafter, it is named a left-hand screw-type protrusion 92).

In the screw-thread part 6 after the screw-forming process, an average height is set as "h" of a screw-ridge 101 from an adjacent screw-bottom 104 in a prescribed area including a maximum diameter part; in the upper side of the screw-thread part 6, the screw-starting part 103 is set at a position of 0° in which a height of the screw-ridge 101 from the adjacent screw-bottom 104 is 0.5h; and the second-step starting part 105 is set at a position of 360° from the screw-starting part 103.

Here, in the screw-thread part 6 of the bottle-can 1, the screw-bottom 104 has substantially a constant outer diameter. A difference of semi-diameters between the screw-ridge 101 and the adjacent screw-bottom 104 is named "a height" of the screw-ridge 101.

Therefore, as shown in FIG. 13 and FIG. 14, the right-hand screw-type protrusion 91 of the inner mold 64A is formed so that: the outer diameter of the screw-ridge 101 of the screw-thread part 6 is increased in a range of 360° from the screw-starting forming part 95 of the inner mold 64A (a position indicated by a dot-and-dash line K); and the height of the screw-ridge 101 from the adjacent screw-bottom 104 is more than 0.5 and less than "h" in a range of 90° from the screw-starting forming part 95. Accordingly, as shown in FIG. 13, the screw-starting forming part 95 of the inner mold 64A is formed to have a height which is Δh lower than the second-step-starting forming part 106 (a position indicated by the dot-and-dash line K).

The screw-starting part 103 will be explained. As shown in FIG. 1, in the screw-thread part 6 of the bottle-can 1, there is an incomplete-thread part 102 in which a height of the screw-ridge 101 from the adjacent screw-bottom 104 is gradually increased up to the prescribed dimension "h". The screw-starting part 103 is a part in which a height of the screw-ridge 101 becomes 0.5h in the incomplete-thread part 102. The screw-starting forming part 95 in the inner mold 64A is a part corresponding to the screw-starting part 103 of the screw-thread part 6. Similarly, a part of the inner mold 64A corresponding to the second-step starting part 105 of the screw-thread part 6 is named the second-step-starting forming part 106 of the inner mold 64A.

The screw-forming process is not necessarily started from the screw-starting part 103; but started from an arbitrary part.

Figure 17:
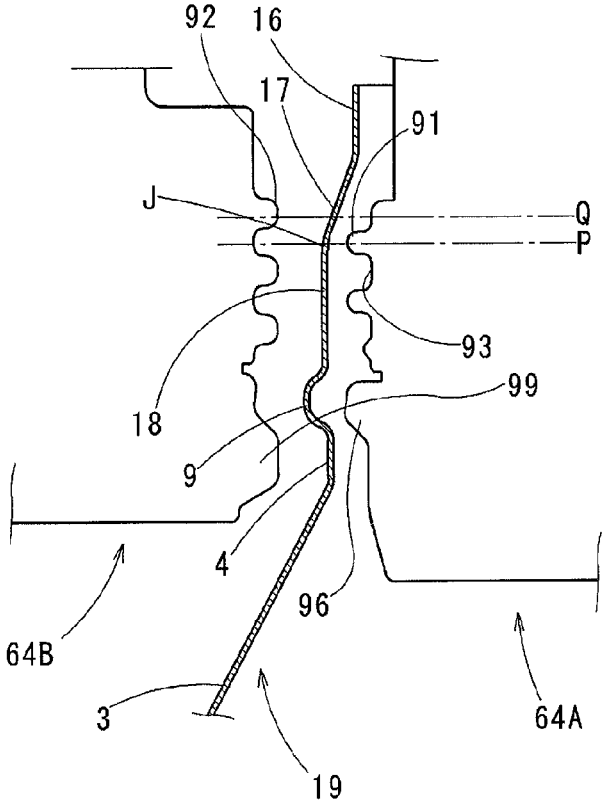
FIG. 17 is a vertical-sectional view showing the intermediate-formed product at a position corresponding to a bottle-can along the can-axis direction at a position of −45° shown in FIG. 1 and a vertical-sectional view showing the screw-forming tool at the position.

FIG. 14 shows a state in which the inner mold 64A and the outer mold 64B are faced each other with a wall of the pipe part 18 therebetween. FIG. 15 shows a state in which the inner mold 64A and the outer mold 64B approach each other and start pressing the pipe part 18 from an intermediate part of the tapered part 17. For convenience, in FIG. 14, the inner mold 64A is viewed from a front; and a half of the outer mold 64B is viewed from a front, and the other half is omitted from illustration. In FIG. 15, FIG. 16, and FIG. 17, the inner mold 64A and the outer mold 64B are illustrated only by outlines. FIG. 17 shows a cross-section of the intermediate-formed product 19 at a position of −45° shown in FIG. 1.

In an angle range of 90° circumferentially continuing from the screw-starting forming part 95, as shown in FIG. 14, a bend part J between the pipe part 18 and the tapered part 17 of the intermediate-formed product 19 is arranged in a range between a second step L and an above screw-bottom M of the right-hand screw-type protrusion 91. In the illustration shown in FIG. 14, the bend part J is arranged nearly at a position of the screw-bottom M. From the state shown in FIG. 14, the inner mold 64A and the outer mold 64B approach each other, so that the pipe part 18 is interposed between the molds and performed the screw-forming process. As a result, at a position of −45° shown in FIG. 1 for example, a maximum outer diameter of the tapered part 17 remaining on an upper part of the screw-ridge 101 that is formed at a highest part is equal to or smaller than the bottom diameter D2.

The screw-forming process is performed by revolving the inner mold 64A and the outer mold 64B along a circumferential direction of the intermediate-formed product 19 with rotating on their axes from a state in which the pipe part 18 is interposed between the inner mold 64A and the outer mold 64B as shown in FIG. 16. Specifically, as shown in FIG. 10, FIG. 11 and FIG. 16 by arrows, the inner mold 64A and the outer mold 64B are rotated (on their own axes and revolved).

Seeing from the aperture-end part 16 toward the bottom part: the inner mold 64A is rotated in right-hand, and the outer mold MB is rotated in left-hand; and the screw-forming tool 42C including the inner mold 64A and the outer mold 64B is revolved in left-hand. Accordingly, the screw-thread part 6 is formed so that the material is drawn from a lower end side of the pipe part 18 toward the aperture-end part 16. At this time, since the surplus-thickness part 9 below the pipe part 18 is held by being sandwiched between the inner-mold swell part 96 of the inner mold 64A and the outer-mold swell part 99 of the outer mold 64B, the bending process is performed in a state in which the tension is enough effected on the pipe part 18, so that a shape of the screw-thread part 6 to be formed is easy to follow a shape of the right-hand screw-type protrusion 91 of the inner mold 64A.

As described above, the right-hand screw-type protrusion 91 of the inner mold 64A is formed so that the height of a first step K is Δh lower than a height of a second step L in the angle range of 90° circumferentially continuing from the screw-starting forming part 95 (FIG. 13). The screw-thread part 6 in the angle range of 90° circumferentially continuing from the screw-starting part 103 is formed following the shape of the right-hand screw-type protrusion 91 of the inner mold 64A so that the height of the first step is lower than the height of the second or subsequent steps of the screw-ridge 101.

Meanwhile, FIG. 17 shows a vertical cross-section at a position before the screw-starting forming part 95 and the screw-starting part 103. In other words, it is a vertical cross-section at a position before the second-step-starting forming part 106 of the right-hand screw-type protrusion 91. In the cross-section in FIG. 17, a position of a dot-and-dash line P indicates a first step (a position of −45° in FIG. 1, which is the right-hand screw-type protrusion 91 before a second step that is 360° from the screw-starting forming part 95); and a position at a dot-and-dash line Q indicates a position before the above screw-bottom.

As shown in FIG. 17, also in the position before the screw-starting forming part 95, by the screw-forming process of an intermediate part of the tapered part 17 in the pipe part 18, the maximum diameter of the tapered part 17 above the position (i.e., a position almost once around) of the first step of the screw-ridge 101 in the screw-thread part 6 is equal to or smaller than the bottom diameter D2.

When the screw-thread part 6 is formed, the surplus-thickness part 9 having a protruded-streak shape or a recessed-groove shape (here, the protruded streak in the present embodiment) provided below the screw-thread part 6 is also finished and formed together so as to be the jaw part 7.

Figure 12:
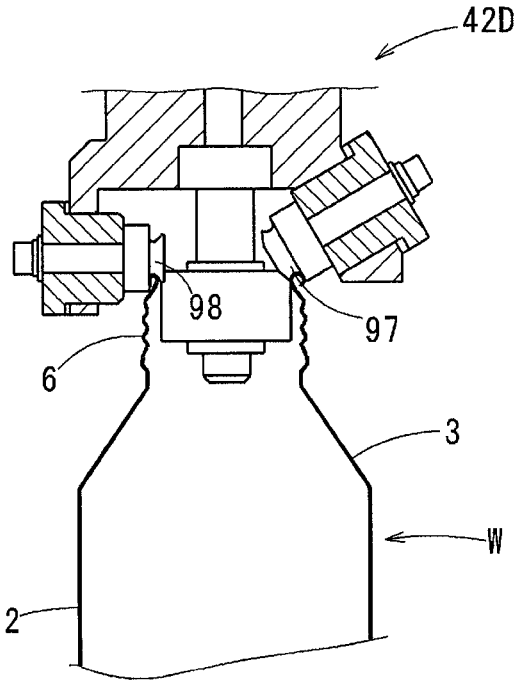
FIG. 12 is a cross-sectional view showing a forming tool for curl part.

After the screw-forming process as describe above, the aperture-end part 16 is further reduced in the diameter, and a curling process is performed on the reduced aperture-end part 16 to form the curl part 8, so that the bottle-can 1 is manufactured. A forming tool 42D forming the curl part 8 has: a rolling die 97 rolling with turning up the aperture-end part 16 of the closed-end cylindrical body W; and a squashing die 98 squashing the aperture-end part radially inward after the curling as shown in FIG. 12. Those dies are each formed in a roll shape and form while being rotated around the closed-end cylindrical body W. In this case, since the curling process is performed after the screw-forming process, the screw-forming can be performed in a state in which the rigidity of the aperture-end part 16 is low.

Meanwhile, a cap 111 which is put on the bottle-can 1 has a circular top-plate part 112 and a cylindrical skirt part 113. The cap 111 is put on the mouth section 5 of the bottle-can 1, and formed by a capping roll so that the skirt part 113 follows the screw-thread part 6 and the jaw part 7 of the mouth section 5, then a screw-thread 114 is formed at the skirt part 113 and the cap 111 is fixed on the mouth section 5 by the screw. By rolling a lower-end part 115 of the skirt part 113 into the jaw part 7, the cap 111 and the bottle-can 1 are fixed by the screw as shown in a left-half of FIG. 18. Since the cap 111 is fixed on the screw-thread part 6 of the mouth section 5 by the screw, an inner diameter of the screw-thread 114 of the cap 111 can be fit to the bottom diameter D2 of the mouth section 5.

As aforementioned, in the screw-forming process, though the height of the first step is formed lower than that of the second or subsequent steps in the screw-ridge 101 of the screw-thread part 6, since a compressive load is applied on along the can-axis direction when the curling process and this capping process are performed, the height of the first step of the screw-ridge 101 is larger than that immediately after the screw-forming process. In this manufacturing method of bottle-can, the screw is formed to a smaller dimension which is set in advance to be lower by the height of change owing to the curling process and the capping process at the screw-ridge 101. Therefore, even though the height is increased by the subsequent compressive load, the height of the first step can be prevented from being larger than the second or subsequent steps at the screw-ridge 101.

Next, a case in which the cap 111 is once opened and then resealed will be explained.

Figure 18:
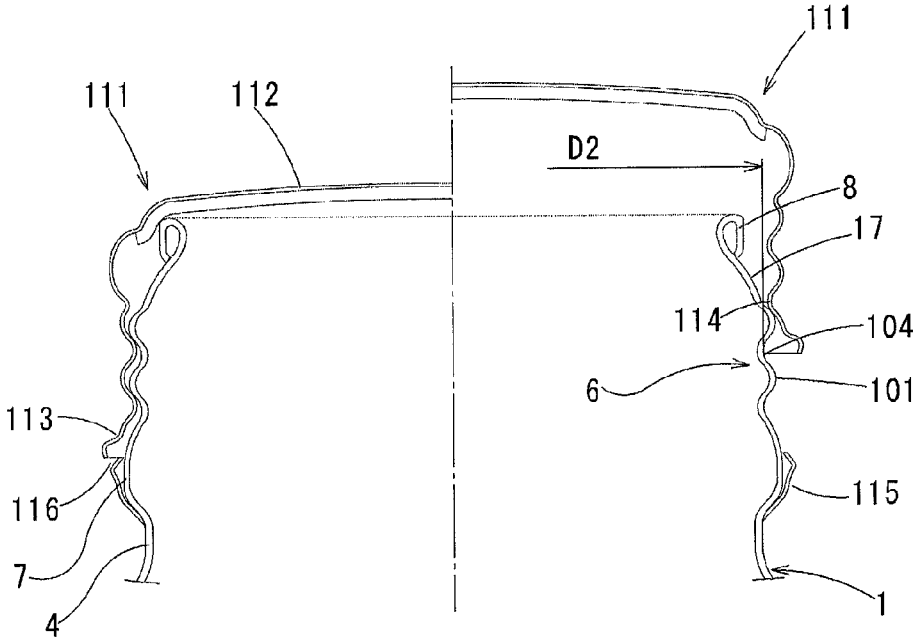
FIG. 18 is a cross-sectional view showing a relationship between a bottle-can and a cap of an embodiment according to the present invention in which a left half shows a state in which the cap is screwed to the bottle-can, and a right half shows a state in which the cap covers the bottle-can but before being screwed again.

When the cap 111 is rotated so as to be unfastened from a state of fixing by the screw shown in the left-half in FIG. 18, slits 116 formed on the skirt part 113 is broken so that the lower-end part 115 and the upper part than the slits are separated, and the lower-end part 115 is remained in a belt-like shape on the jaw part 7; as a result, an upper part of the cap 111 can be removed from the mouth section 5.

Next, when the removed cap 111 is put on the mouth section 5 for resealing, as shown in a right-half in FIG. 18, a lowest end of the screw-thread 114 of an inner circumferential surface of the cap 111 comes down with sliding on the tapered part 17 of the mouth section 5. In the angle range of 90° circumferentially continuing from the screw-starting part 103 of the bottle-can 1, the height of the first step of the screw-ridge 101 is lower than that of the second and subsequent steps in the screw-thread part 6 when the screw is formed so as not to be larger than the second and subsequent steps even though the compressive load is applied by the curling process and the capping process. Accordingly, when the lowest end of the screw-thread 114 of the cap 111 in this range, is in contact with an upper surface of the first step of the screw-ridge 101, the resistance for climbing over the screw-ridge 101 at the first step is small. Therefore, the lowest end of the screw-thread 114 can be easily arranged in the screw-bottom 104 between the first step and the second step of the screw-ridge 101.

When the lowest end of the screw-thread 114 of the cap 111 is in contact with the screw-thread part 6 of the bottle-can 1 at the other part than the angle range of 90° from the screw-starting part 103, by rotating the cap 111 in right-hand direction, the lowest end of the screw-thread 114 follows the upper surface of the first step of the screw-ridge 101, and is guided to an access of the below screw-bottom 104.

As aforementioned, since the tapered part 17 is formed to have the maximum outer diameter equal to or smaller than the bottom diameter D2, the screw-thread 114 on the inner circumferential surface of the cap 111 has scarcely the resistance of the tapered part 17, smoothly reaches the upper surface of the first step of the screw-ridge 101, and then is easily guided to the access of the screw-bottom 104 below the first step.

After guiding the lowest end of the screw-thread 114 of the cap 111 to the screw-bottom 104 between the first step and the second step of the screw-ridge 101 in the screw-thread part 6 of the bottle-can 1, the lowest end of the screw-thread 114 enters along the screw-bottom 104 by rotating the cap 111, so that it can be fitted by the screw.

Figure 19:
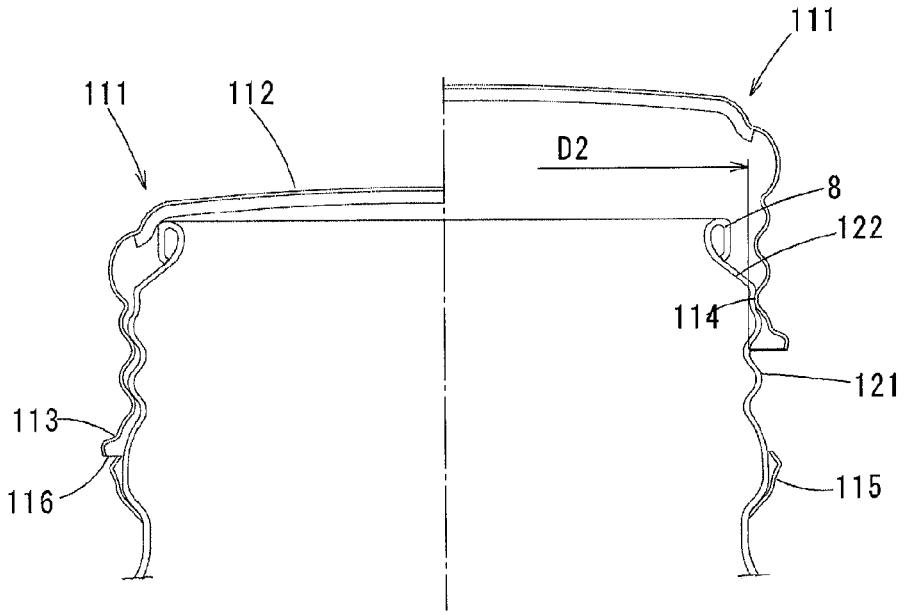
FIG. 19 is a cross-sectional view as FIG. 17 showing a conventional relationship between a bottle-can and a cap.

Incidentally, in a case of a conventional bottle-can, as shown in FIG. 19, a larger part than the bottom diameter D2 is remained in a tapered part 122 above a first step of a screw-ridge 121 of a screw-thread part of a bottle-can. Accordingly, when resealing the cap 111, the screw-thread 114 of the cap 111 is in contact strongly with the larger part than the bottom diameter D2 and a resistance for screwing is large. As a result, it is hard to perform resealing.

Here, an Example according to the present invention and a Comparative Example will be described. A screw-threaded bottle-can of the Example was obtained by forming with revolving the screw-forming tool in the left-hand direction by seeing from the aperture-end toward the bottom part in the screw-forming process as same as in the aforementioned embodiment. Meanwhile, a screw-threaded bottle-can of the Comparative Example was obtained by forming with revolving the same screw-forming tool as that forming the bottle-can of the Example in a counter direction to the embodiment.

Figure 20:
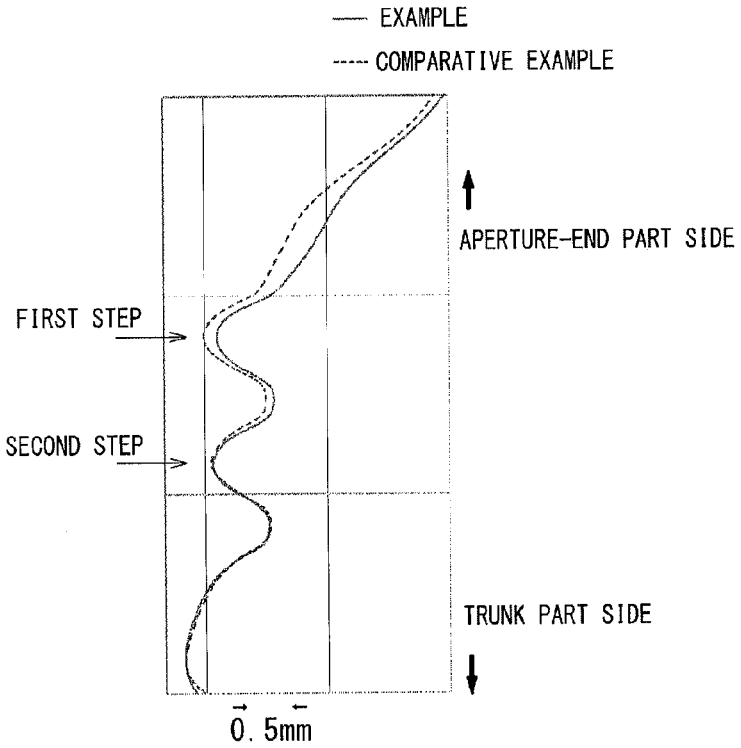
FIG. 20 is a vertical-sectional view along the can-axis direction corresponding to a position of −45° shown in FIG. 1 showing the screw-thread parts of the bottle-cans according to an example and a comparative example.

FIG. 20 shows outlines of the screw-threaded bottle-cans according to the Example and the Comparative Example in the vicinity of the screw-thread part at a position of −45° shown in FIG. 1. In the bottle-can of the Example (the shape by a solid line) in which the screw-thread part was formed from the trunk part side toward the aperture-end part side by revolving the screw-forming tool in the left-hand direction, the first step was formed lower than the second step in the screw-ridge. On the other hand, the bottle-can of the Comparative Example (the shape by a dotted line) in which the screw-thread part was formed from the aperture-end part side toward the trunk part side by revolving the screw-forming tool in the right-hand direction, the first step was formed higher than the second step in the screw-ridge.

Resistance values of screwing the cap on the mouth section of the bottle-cans according to the Example and the Comparative Example were compared. Resealing torques were measured when resealing the cap on the bottle-cans being held by a digital torque meter made by Nidec-Shimpo Corporation. The resealing torque was a resistance value which was generated when sealing the cap on the mouth section before a liner on a top surface of the cap was in contact with a top surface of a curl part of the bottle-can. The resealing torque of the bottle-can of the Example was 0.2 N·cm. The resealing torque of the bottle-can of the Comparative Example was 8.7 N·cm.

The present invention is not limited to the above-described embodiments and various modifications may be made without departing from the scope of the present invention.

INDUSTRIAL APPLICABILITY

A manufacturing method and a manufacturing apparatus of a screw-threaded bottle-can which can perform a screw-thread forming without damaging to coatings and the like, with stable dimensions, and improve the resealing performance can be provided.

DESCRIPTION OF THE REFERENCE SYMBOLS

1 bottle-can
2 trunk part
3 shoulder part
4 neck part
5 mouth section
6 screw-thread part
7 jaw part
8 curl part
9 surplus-thickness part
13 stepped-formed product
14 large-diameter part
15 reduced-diameter part
16 aperture-end part
17 tapered part
18 pipe part
19 intermediate-formed product
20 manufacturing apparatus of bottle-can
22 driving device
30 work-holding unit
32 holder
40 tool-holding unit
42, 42A to 42D forming tool
51 diameter-expansion punch
52 inner die
53 outer die
61 first housing
62 second housing
64A inner mold
64B outer mold
67, 68 block body
71 to 74 gear
81 assistance-block body
83, 84 cam roller
86, 87 cam face
91 right-hand screw-type protrusion (screw-forming protrusion)
92 left-hand screw-type protrusion (screw-forming protrusion)
93, 94 screw-forming recess
95 screw-starting forming part
96 inner-mold swell part
97 rolling die
98 squashing die
99 outer-mold swell part
101 screw-ridge
102 incomplete-thread part
103 screw-starting part
104 screw-bottom
105 second-step starting part (of the screw-thread part)
106 second-step-starting forming part (of the inner mold)
111 cap
112 top-plate part
113 skirt part
114 screw-thread
115 lower-end part
116 slit
W closed-end cylindrical body
h average height of screw-ridge

What is claimed is:

1. A manufacturing method of a screw-threaded bottle-can, comprising:

an intermediate-formed product forming process forming an intermediate-formed product having a shoulder part which is gradually tapered upward from an upper end of a trunk part, a neck part which is extended upward from an upper end of the shoulder part having a cylindrical shape, a surplus-thickness part which is swelled out as a protrusion streak or swelled in as a recessed groove round an upper end part of the neck part, a pipe part which is extended upward from an upper end of the surplus-thickness part, and a tapered part which is tapered from an upper end of the pipe part toward an aperture-end part; and a screw-forming process using a screw-forming tool provided with: an inner mold having a right-hand screw-type protrusion and an inner-mold swell part swelling outward around a lower part of the right-hand screw-type protrusion; and an outer mold having a left-hand screw-type protrusion and an outer-mold swell part swelling outward around a lower part of the left-hand screw-type protrusion, arranging the inner mold inside the pipe part and the surplus-thickness part and arranging the outer mold outside the pipe part and the surplus-thickness part, interposing the surplus-thickness part and a vicinity of the pipe part between the inner mold and the outer mold, and rolling the screw-forming tool in the interposing state, in a circumferential direction of the pipe part while revolving in a left-hand direction by seeing from the aperture end toward a bottom part of the intermediate-formed product so that a screw-thread part and a jaw part swelling outward around a lower part of the screw-thread part are formed on the intermediate-formed product; wherein in the intermediate-formed product forming process, an outer diameter of the pipe part is formed to have an intermediate outer diameter between an outer diameter of a screw-ridge and an outer diameter of a screw-bottom of the screw-thread part after the screw-forming process;

the screw-forming tool is provided to form larger clearances than a plate-thickness of the intermediate-formed product between the right-hand screw-type protrusion of the inner mold and a screw-bottom of the left-hand screw-type protrusion of the outer mold and between a screw-bottom of the right-hand screw-type protrusion of the inner mold and the left-hand screw-type protrusion of the outer mold in the interposing state in the screw-forming process;

in the screw-thread part after the screw-forming process, an average height is set as "h" of the screw-ridge from the adjacent screw-bottom in a prescribed area including a maximum diameter part; a screw-starting part is set at a position of 0° in which a height of the screw-ridge from the adjacent screw-bottom is 0.5h above the screw-thread part; and a second-step starting part is set at a position of 360° from the screw-starting part;

in the right-hand screw-type protrusion of the inner mold, a part forming the second-step starting part of the screw-thread part is set as a second-step-starting forming part;

in the screw-forming process, the screw-forming tool and the intermediate-formed product are arranged so that a bend part between the tapered part and the pipe part in a vertical cross-section of the intermediate-formed product along a can-axis direction in the screw-starting part is arranged between a screw-ridge of the second-step-starting forming part of the inner mold and a screw-bottom above the screw-ridge;

the screw-ridge is formed so that an outer diameter thereof is increased in a range of 360° from the screw-starting part to the second-step starting part, and so that a height of the screw-ridge from the adjacent screw-bottom is more than 0.5h and less than "h" in a range of 90° from the screw-starting part; and the screw-starting part is formed at an intermediate position of the tapered part of the intermediate-formed product, and the screw-thread part is formed from the tapered part to the pipe part.

2. The manufacturing method of a screw-threaded bottle-can according to claim 1, wherein the tapered part has an angle of 10° to 30° with respect to the can-axis direction.

3. The manufacturing method of a screw-threaded bottle-can according to claim 1, further comprising a curling process forming a curl part at an upper part than the screw-thread part by folding back and rounding the aperture-end part and crushing radially inward after the screw-forming process.

* * * * *